US006572398B2

(12) United States Patent
Onuma

(10) Patent No.: US 6,572,398 B2
(45) Date of Patent: Jun. 3, 2003

(54) ELECTRICAL CONNECTION TERMINAL

(75) Inventor: Masanori Onuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/090,641

(22) Filed: Mar. 6, 2002

(65) Prior Publication Data

US 2002/0127905 A1 Sep. 12, 2002

(30) Foreign Application Priority Data

Mar. 7, 2001 (JP) ..... 2001-063871

(51) Int. Cl.[7] ..... H01R 11/20; H01R 4/24
(52) U.S. Cl. ..... 439/422
(58) Field of Search ..... 439/421–424

(56) References Cited

U.S. PATENT DOCUMENTS 4,106,836 A * 8/1978 Asick et al. ..... 439/422
4,411,484 A * 10/1983 Casey ..... 439/422
4,784,623 A * 11/1988 Beck, Jr. ..... 439/872
5,137,468 A * 8/1992 Murakami ..... 439/422
6,267,618 B1 * 7/2001 Hio ..... 439/422
6,312,283 B1 * 11/2001 Hio ..... 439/422

FOREIGN PATENT DOCUMENTS

JP 4-8372 1/1992
JP 11-144780 5/1999

* cited by examiner

*Primary Examiner*—Gary Paumen
*Assistant Examiner*—James R. Harvey
(74) *Attorney, Agent, or Firm*—Sughrue Mion, PLLC

(57) ABSTRACT

Each of the end parts of the piercing portions (25 and 26) of an electrical connection terminal 21 has a pair of piercing blades (31, 31 (or 32, 32)) formed by providing a notch portion (34 (or 35)) therebetween. The piercing portions (25 and 26) paired to each other are adapted so that the piercing blade (32 (or 31)) is placed at the notch portion of each of the opposed piercing portions, and that when the piercing portions, which penetrate the flat circuit body, are folded back in a direction in which the piercing portions approach each other, the piercing blade of one of the piercing portions is inserted into the notch portion of the other piercing portion.

3 Claims, 12 Drawing Sheets

ELECTRICAL CONNECTION TERMINAL

BACKGROUND OF THE INVENTION

The present invention relates to an improvement of an electrical connection terminal to be connected to a flat circuit body by folding back each of end parts of at least a pair of piercing portions, which are erected on opposite side edge parts of a planar portion, in a direction in which the end parts approach each other, after penetrating a coating and a conductor of the flat circuit body.

FIG. 10 illustrates a primary part of each of a flat circuit body 1 and a related electrical connection terminal 2 to be connected to the flat circuit body 1.

The flat circuit body 1 is an FFC (Flexible Flat Cable) manufactured as a band-like cable which includes a thin film insulating coating 5 covering a plurality of long-thin-plate-like conductors 4 and has flexibility as a whole.

The conductor 4 is formed by various kinds of manufacturing methods, for example, a pattern printing method, or a method of attaching a preliminarily tape-shaped conductive material to an insulating sheet.

The electrical connection terminal 2 is disclosed in, for instance, JP-A-11-144780, and has a structure in which the planar portion 6, a plurality of pairs of piercing portions 7 and 8 erected on opposite side edge parts of a base-side part of the planar portion 6, and a terminal connection portion (not shown) formed at an end side part of the portion 6 are integrally formed with one another.

The terminal connection portion (not shown) is used for connecting the electrical connection terminal 2 to another electrical connection terminal, and formed in such a way as to have a female or male terminal structure, which is stored and held in a connector housing. Incidentally, the plurality of pairs of piercing portions 7 and 8 may be formed at opposite ends of an electrical connection terminal and used for connecting the flat circuit bodies 1 to each other.

The electrical connection terminal 2 is so-called a piercing terminal. As illustrated in FIG. 11, the electrical connection terminal 2 is electrically and mechanically connected to the flat circuit body 1 by being folded back in a direction in which the tip ends of the piercing portions 7 and 8 provided on opposite side edge parts of the planar portion 6 approach each other, after penetrating the insulating coating 5 and the conductor 4 of the flat circuit body 1.

As shown in FIG. 10, in the electrical connection terminal 2, the end part of each of the piercing portions 7 and 8 is shaped like letter V. The piercing portions 7 and 8 of each of the pairs are formed so that the top parts of the paired piercing portions 7 and 8 are aligned with each other.

Thus, as illustrated in FIG. 12, in a state that the end parts of the piercing portions 7 and 8 of each of the pairs are folded back, top parts 7*a* and 8*a* of the piercing portions 7 and 8 are arranged in such a way as to be close to each other when seen in a plan view thereof. As shown in FIG. 13, the tapering end parts of the piercing portions 7 and 8 of each of the pair are put in a state that the end parts of the piercing portions 7 and 8 sandwich and support the corresponding conductor 4 provided on the flat circuit body 1 to thereby perform electrical connection on the conductors 4.

However, as illustrated in FIG. 13, each of the piercing portions 7 and 8 of the aforementioned electrical connection terminal 2 is brought into firm contact with the corresponding conductor 4 provided on the flat circuit body 1, only at the tapering end part thereof which abuts against the corresponding conductor 4 during sandwiching and supporting this conductor 4. Therefore, each of the piercing portions 7 and 8 is nearly in point contact with the corresponding conductor 4.

Accordingly, the contact area between the conductor 4 and each of the piercing portions 7 and 8 is small. Consequently, there has been caused a problem that it is difficult to improve electrical connection characteristics by increasing the contact area therebetween.

As illustrated in FIG. 11, the aforementioned electrical connection terminal 2 ensures dimensions $L_1$ and $L_2$, which are respectively required to fold back the piercing portions 7 and 8, and ensures a dimension $L_4$ that is necessary for preventing an occurrence of the interference between the piercing portions 7 and 8 of each of the pairs. Therefore, a large occupied width is needed as the occupied width of the single electrical terminal 2 in the flat circuit body 1.

Consequently, the arranging pitch $P_1$ of the adjacent conductors 4 provided on the flat circuit body 1 increases. Therefore, there has been caused a problem of an increase in the size of the flat circuit body 1.

An electrical connection terminal 11 shown in FIGS. 14 and 15 has been proposed as a counter measure against, for example, the latter problem. Further, another electrical connection terminal 15 shown in FIGS. 16 and 18 has been proposed as a countermeasure against the former problem.

The electrical connection terminal 11 shown in FIGS. 14 and 15 is configured so that the plurality of piercing portions 7 and 8 erected on opposite side edge parts of the planar portion 6 are arranged in a staggered manner in which the top parts of the piercing portions 7 and 8 of each of the pairs are alternately arranged, and that the end part of each of the piercing portions 7 provided on one of opposite sides is placed next to the end part of a corresponding one of the piercing portions 8 provided on the other side (along the longitudinal direction of the planar portion 6).

Although the dimensions $L_1$ and $L_2$ required to respectively fold back the piercing portions 7 and 8 are unchanged when the electrical connection terminal 11 is configured in this manner, the occupied width $L_3$ of the piercing portions 7 and 8 on the conductor 4 of the flat circuit body 1 can be reduced by a dimension S of an overlapping width of a folded-back part of each of the piercing portions 7 and 8. Thus, the electrical connection terminal 11 can cope with a reduction in the width of each of the conductors.

However, the longitudinal dimension of the aforementioned electrical connection terminal 11 is large owing to the staggered arrangement of the plurality of piercing portions 7 and 8, in which the top parts thereof each of the pairs are alternately arranged. Thus, there has been a problem that it is difficult to reduce the size of a single electrical connection terminal.

On the other hand, the electrical connection terminal 15 illustrated in FIGS. 16 to 18 is configured so that the end part of each of the piercing portions 7 and 8 erected on opposite the side edge parts of the planar portion 6 is formed into a flat shape obtained by cutting off a sharp end part thereof, as illustrated in FIG. 16.

Therefore, as shown in FIG. 18, the end of each of the piercing portions 7 and 8 is nearly in line contact with the corresponding conductor 4 of the flat circuit body 1. Consequently, an increase in the contact area can result in an improvement of the electrical connection characteristics.

However, as compared with the aforementioned electrical connection terminal 2 adapted so that each of the piercing portions 7 and 8 has a sharp end part, it is difficult for the electrical connection terminal 15 to penetrate the flat circuit body 1. Preprocesses, such as a process of preliminarily forming slits for enabling the piercing portions to pass through the flat circuit body 1, are needed for enabling each of the piercing portions 7 and 8 to reliably penetrate the flat circuit body 1. Therefore, there has been caused a problem that the productivity of a manufacturing method therefor lowers owing to an increase in the number of production steps.

Further, each of the aforementioned electrical connection terminals 11 and 15 has a structure wherein the opposed piercing portions 7 and 8 are folded back independent of each other in a direction in which the portions 7 and 8 come closer to each other. Thus, for example, the end part of the piercing portion 8 folded back as indicated by two-dot chain lines in FIG. 19 springs back to an original position thereof, as indicated by an arrow A. Consequently, each of the electrical connection terminals 11 and 15 fixed to the flat circuit body 1 is loosened. Therefore, there is the possibility that the electrical-conductivity reliability lowers owing to an occurrence of backlash.

Therefore, in order to prevent the electrical conductivity reliability of the terminal from being degraded owing to such spring back, it has been proposed that, as illustrated in FIG. 20, the electrical connection terminal 20 has what is called a double pierced structure formed by providing a convex portion (or an indent portion) 10 for pushing up the flat circuit body 1 in a central part of the planar portion 6 of the electrical connection terminal 20, and by preliminarily forming through holes 12 and 14, through which the end parts of the respective piercing portions 7 and 8 can pass, parts located at both sides of the convex portion 10, and causing the end parts of the piercing portions 7 and 8 of each of the pairs to penetrate the flat circuit body 1 again when folding back each of the pairs of the piercing portions 7 and 8 having been caused to penetrate the flat circuit body 1 once.

However, although the degradation in the conductivity reliability can be suppressed by taking such a countermeasure to thereby lower the degree of the looseness due to the spring back, a gap $L_4$ to be ensured for performing a double piercing process on the piercing portions 7 and 8 of each of the pairs is further increased. Consequently, the aforementioned arrangement pitch $P_1$ of the conductors 4 in the flat circuit body 1 is further increased. Therefore, there has been caused a problem that the size of the flat circuit body 1 is increased still more.

SUMMARY OF THE INVENTION

Accordingly, an object of the invention is to solve the aforementioned problems, and to provide an electrical connection terminal enabled to improve the electrical conductivity thereof to a flat circuit body and to reduce the width of the flat circuit body.

In order to solve the aforesaid object, the invention is characterized by having the following arrangement.

(1) An electrical connection terminal adapted to be connected to a flat circuit body, comprising:

a planar portion; and a pair of piercing portions erected on opposite side edge parts of the planar portion, each of the pair of piercing portions including, a plurality of piercing blades formed at an end of the piecing portion, and a notch portion formed between the plurality of piercing blades, wherein one of the plurality of piercing blades of one of the pair of piercing portions is placed at a position of the notch portion of the other piercing portion, and wherein when the pair of piercing portions penetrates the flat circuit body and are folded back in a direction in which the pair of piercing portions approach each other, the one of the plurality of piercing blade of one of the pair of piercing portion is inserted into the notch portion of the other piercing portion.

(2) The electrical connection terminal according to (1), wherein the planar portion is provided with a convex portion at a center thereof.

(3) The electrical connection terminal according to (1), wherein the pair of piercing portions offset each other in a direction in which the planar portion extends.

DETAILED DESCRIPTION OF PREFERRED EMBODIMENTS

Hereinafter, an electrical connection terminal according to an embodiment of the invention is described in detail with reference to the accompanying drawings.

Figure 1:
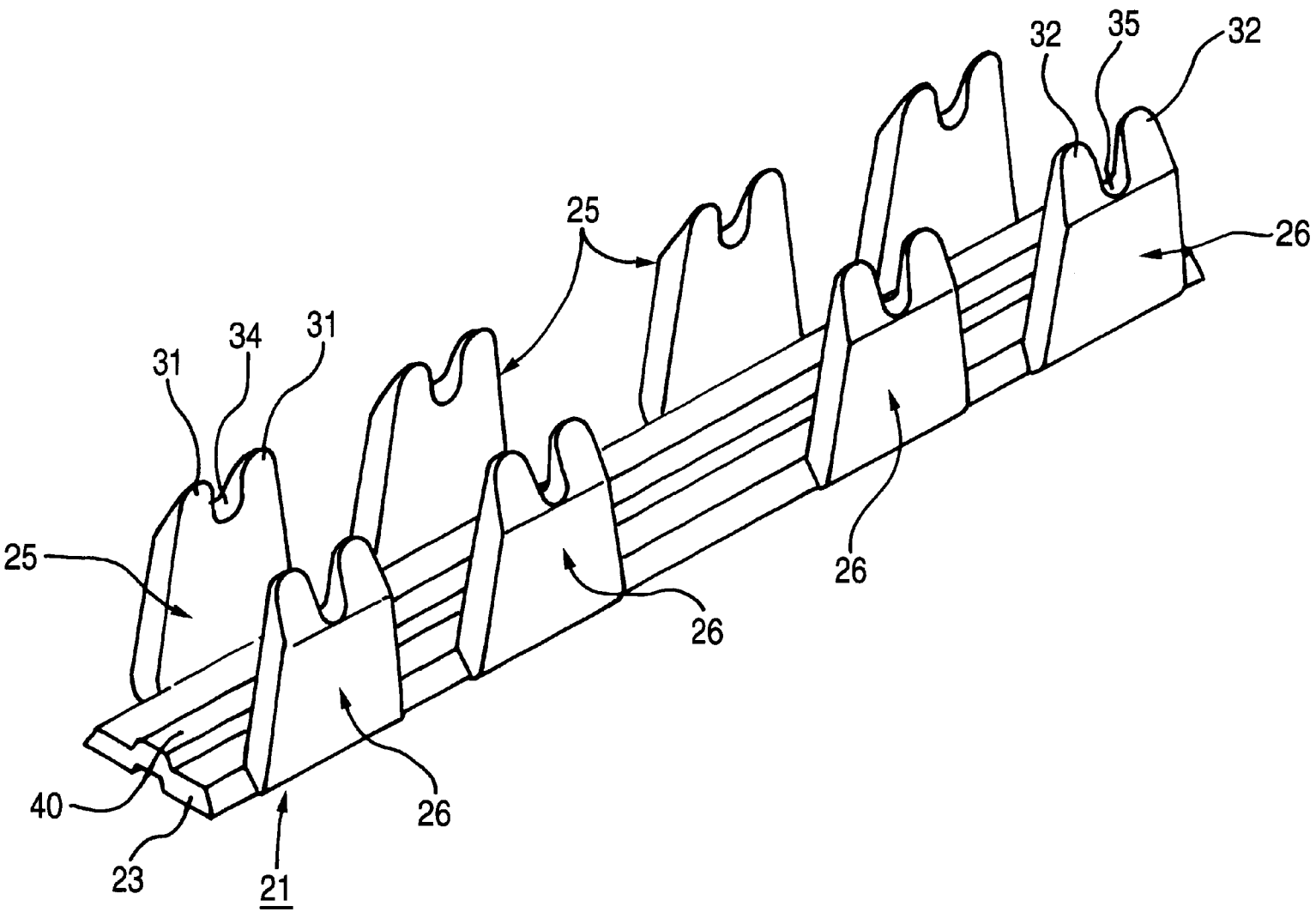
FIG. 1 is a perspective view illustrating the entirety of an electrical connection terminal that is an embodiment of the invention.
Figure 2:
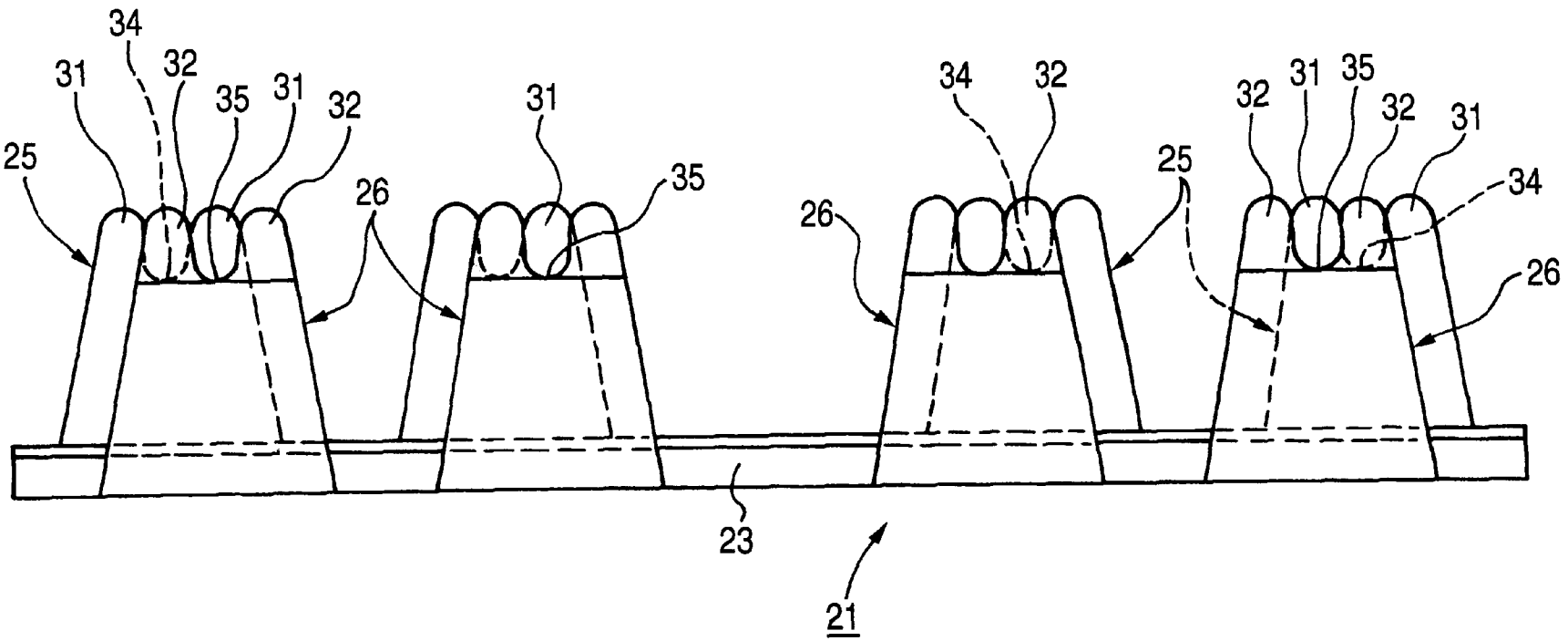
FIG. 2 is a plan view illustrating the electrical connection terminal illustrated in FIG. 1.
Figure 3:
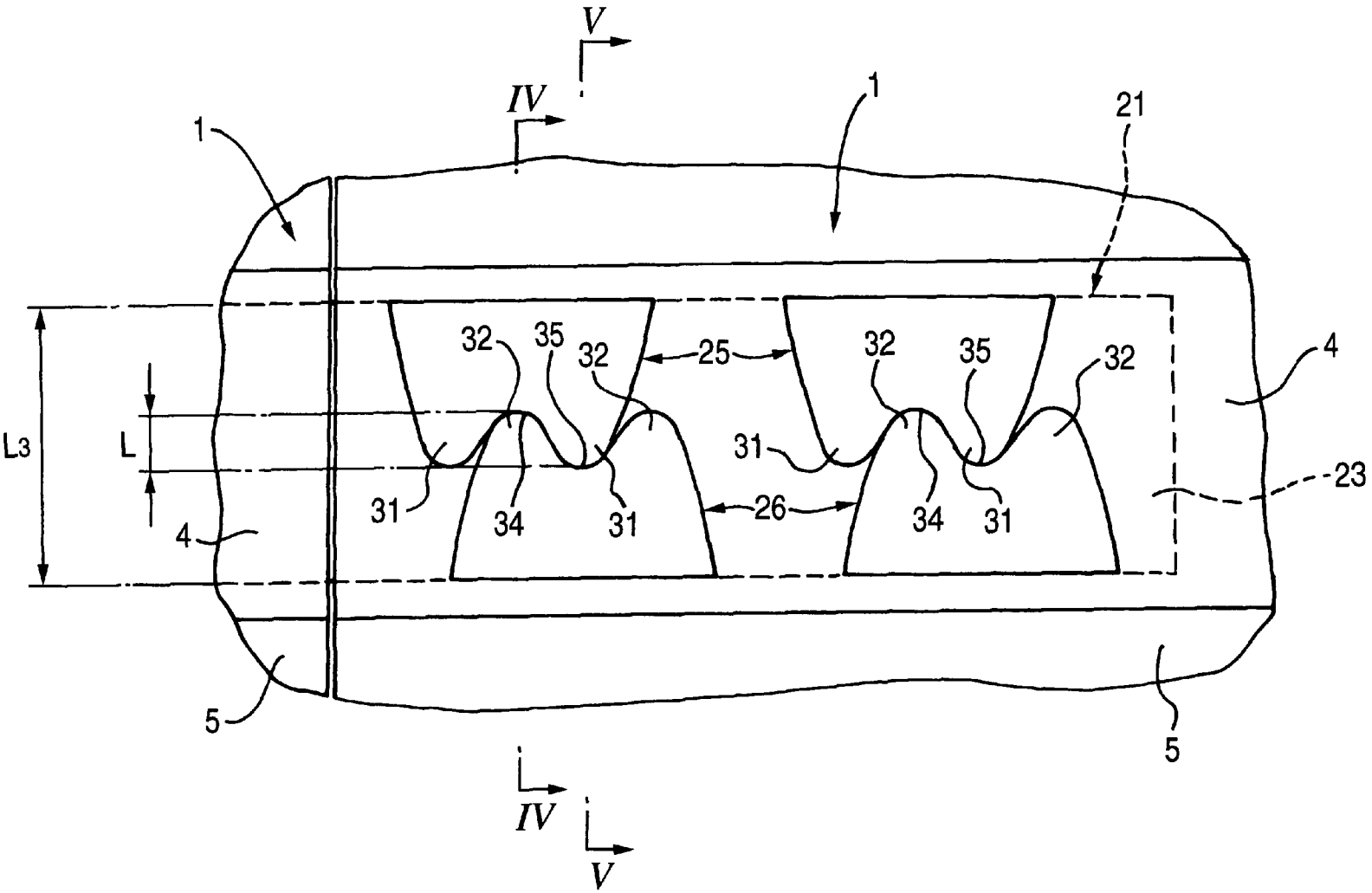
FIG. 3 is an enlarged primary-part plan view illustrating a primary part put into a state in which the electrical connection terminal shown in FIG. 1 is attached to a flat circuit body.
Figure 4:
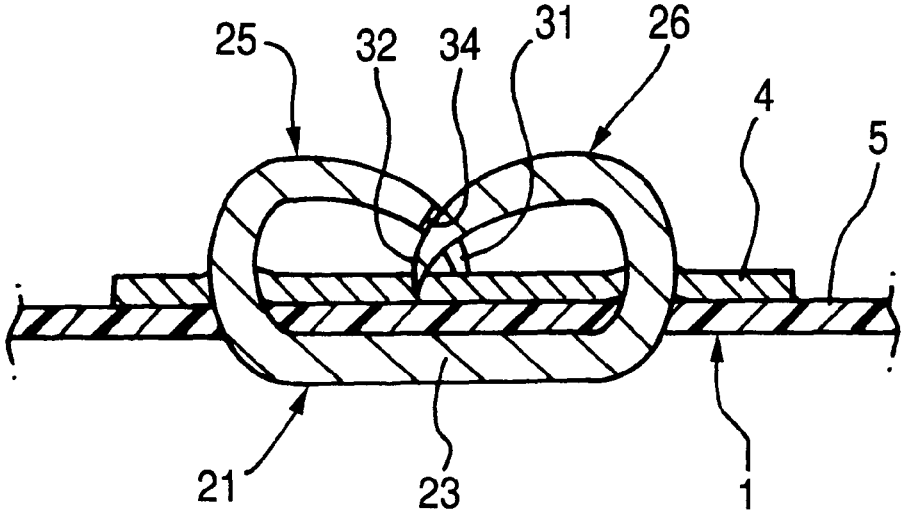
FIG. 4 is a sectional view taken in the direction of arrows along line IV—IV of FIG. 3.
Figure 5:
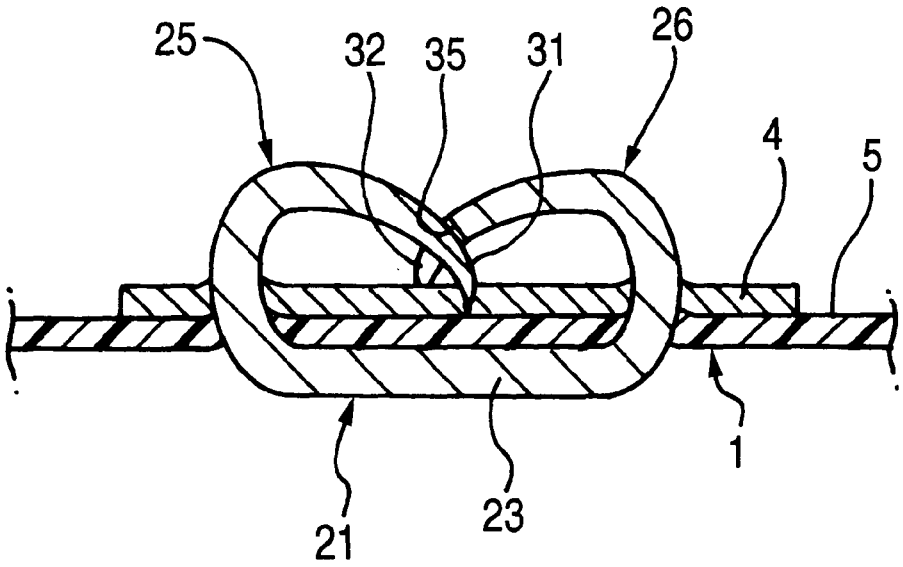
FIG. 5 is a sectional view taken in the direction of arrows along line V—V of FIG. 3.
Figure 6:
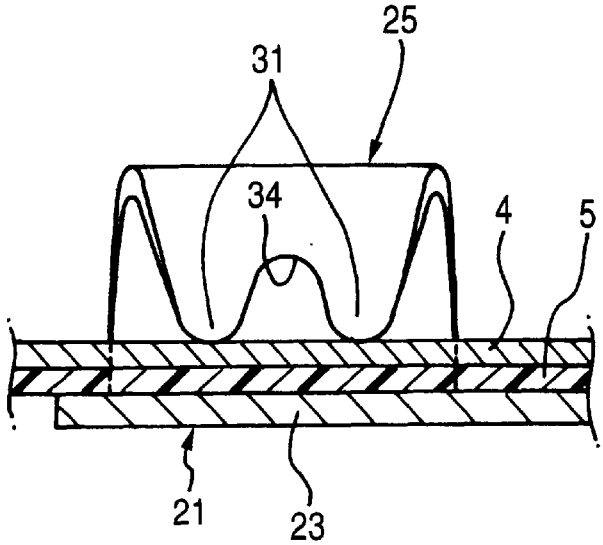
FIG. 6 is a sectional view taken in the direction of arrows along line VI—VI of FIG. 3.
Figure 7:
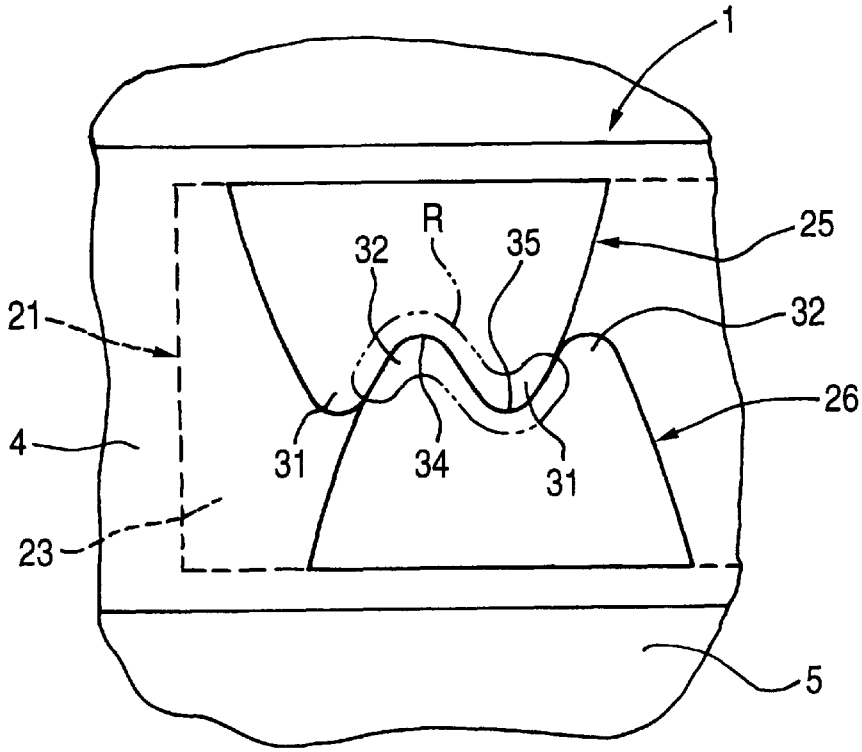
FIG. 7 is an enlarged plan view illustrating an operation of a primary part of piercing portions shown in FIG. 3.
Figure 8:
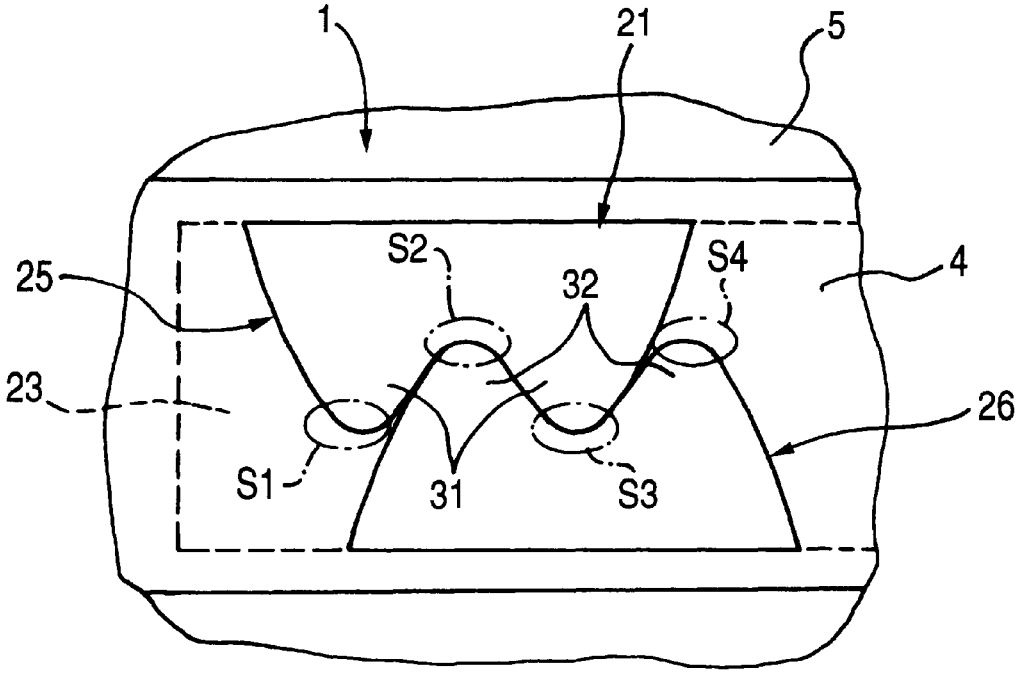
FIG. 8 is an enlarged plan view illustrating an operation of a primary part of the piercing portions shown in FIG. 3.
Figure 9:
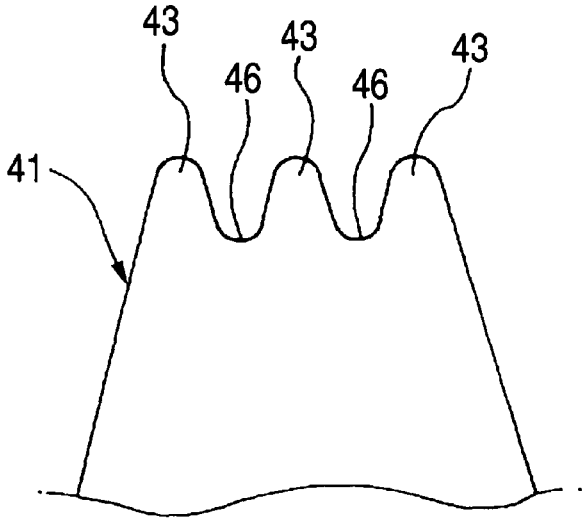
FIG. 9 is an enlarged primary-part front view illustrating a primary part of a modification of each of the piercing portions of the electrical connection terminal that is the embodiment of the invention.

FIG. 1 is a perspective view illustrating the entirety of an electrical connection terminal according to an embodiment of the invention. FIG. 2 is a plan view illustrating the electrical connection terminal illustrated in FIG. 1. FIG. 3 is a primary-part enlarged plan view illustrating a primary part put into a state that the electrical connection terminal shown in FIG. 1 is attached to a flat circuit body. FIG. 4 is a sectional view taken in the direction of arrows along line IV—IV of FIG. 3. FIG. 5 is a sectional view taken in the direction of arrows along line V—V of FIG. 3. FIG. 6 is a sectional view taken in the direction of arrows along line VI—VI of FIG. 3. Each of FIGS. 7 and 8 is an enlarged primary-part plan view illustrating an operation of a primary part of piercing portions shown in FIG. 3.

The electrical connection terminal 21 according to this embodiment is used for connecting flat circuit bodies to each other by folding back end parts of four pairs of piercing portions 25 and 2 which are erected on opposite side edge parts of a planar portion 23, after causing each of the end parts of the four pairs of piercing portions 25 and 26 to penetrate through an insulating coating 5 and a conductor 4 of the flat circuit body 1 (see FIG. 3).

Figure 10:
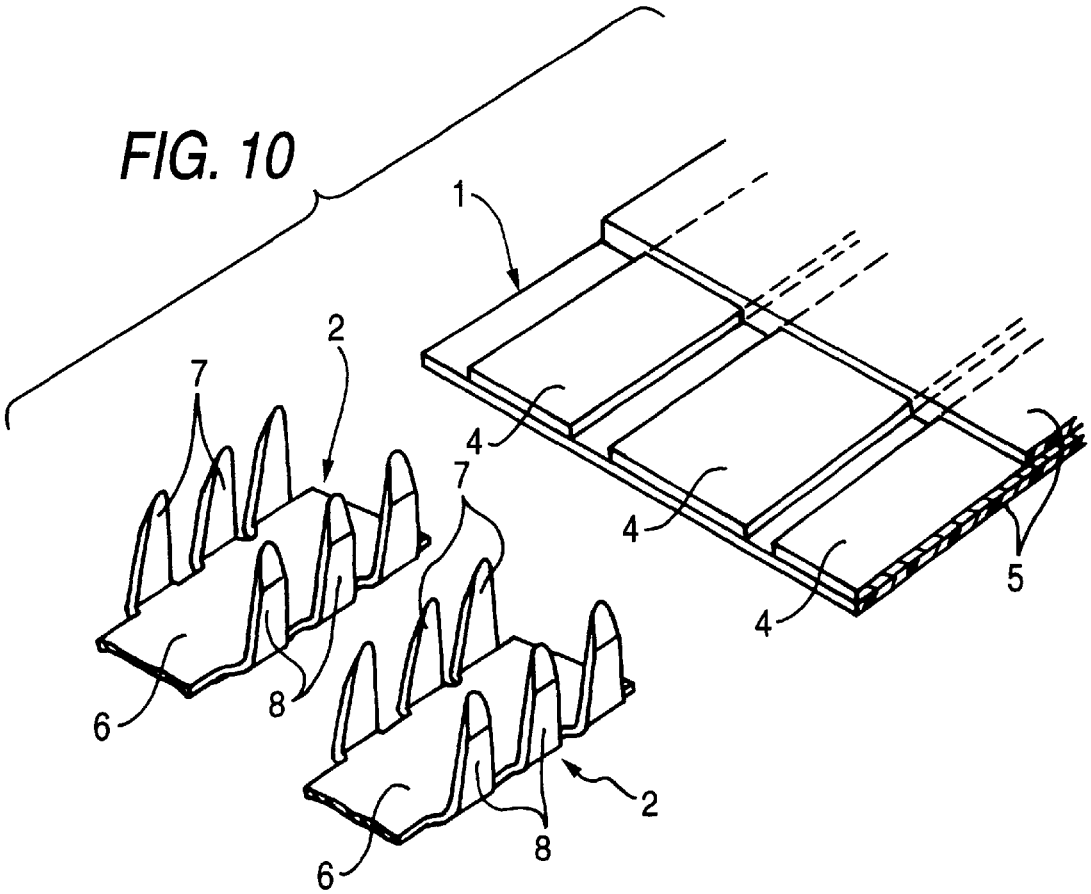
FIG. 10 is a perspective view illustrating a related electrical connection terminal to be connected to a flat circuit body.
Figure 11:
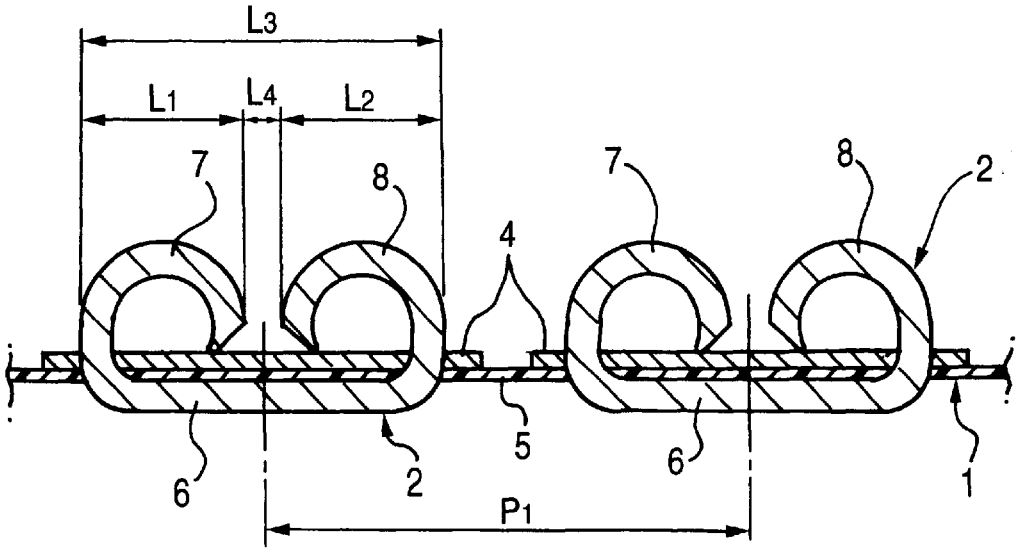
FIG. 11 is a transverse sectional view illustrating a connection portion at which the electrical connection terminal shown in FIG. 10 is connected to the flat circuit body.
Figure 12:
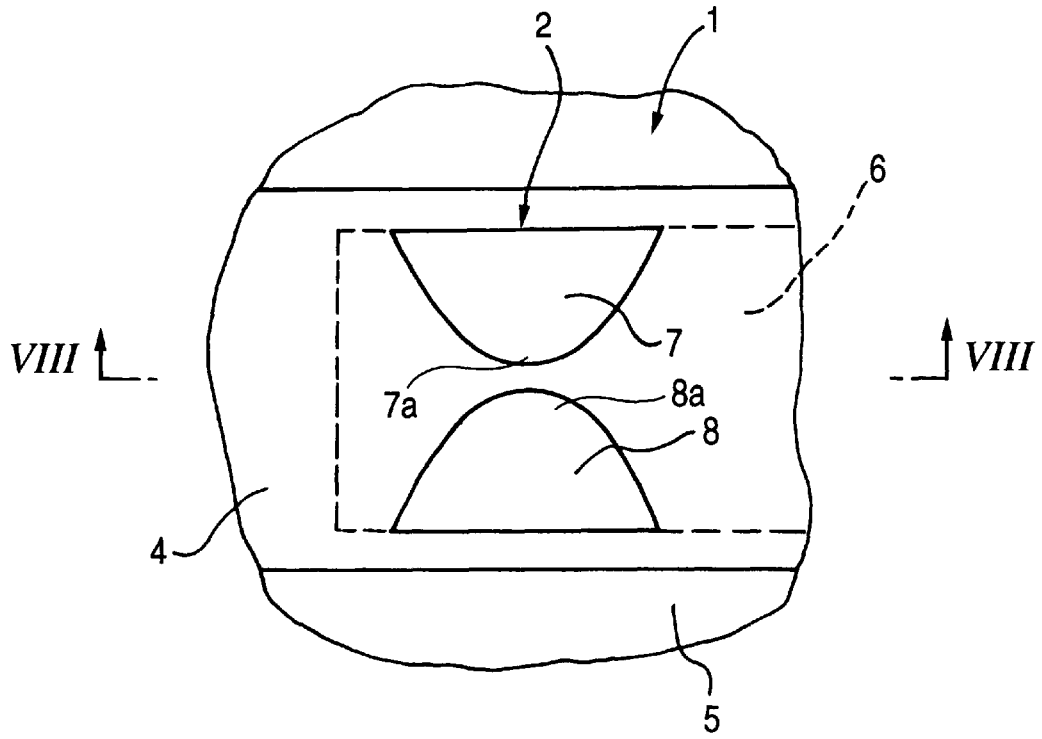
FIG. 12 is a plan view illustrating a state in which each of pairs of opposed piercing portions of the electrical connection terminal shown in FIG. 10 is folded back in a direction in which the opposed piercing portions of each of pairs approach each other.
Figure 13:
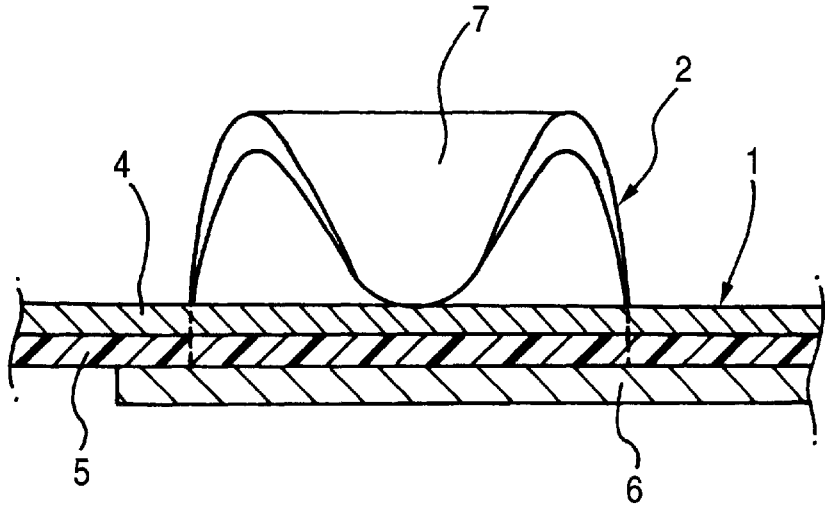
FIG. 13 is a sectional view taken in the direction of arrows along line XIII—XIII of FIG. 12.
Figure 14:
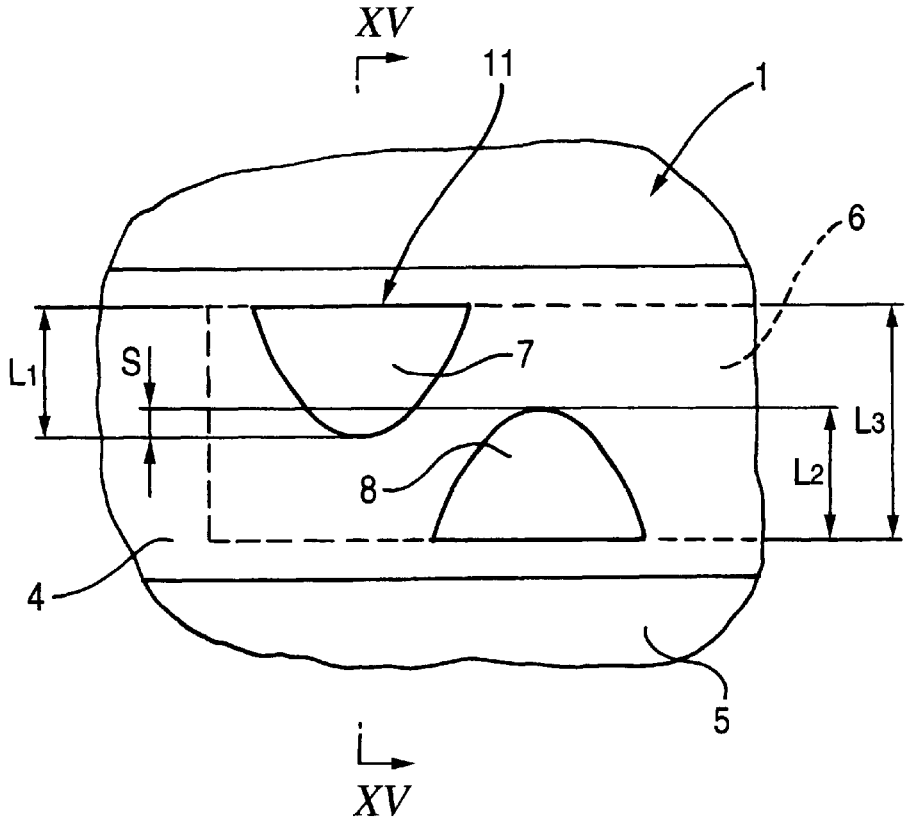
FIG. 14 is a plan view illustrating a state in which an improved related electrical connection terminal is attached to a flat circuit body.
Figure 15:
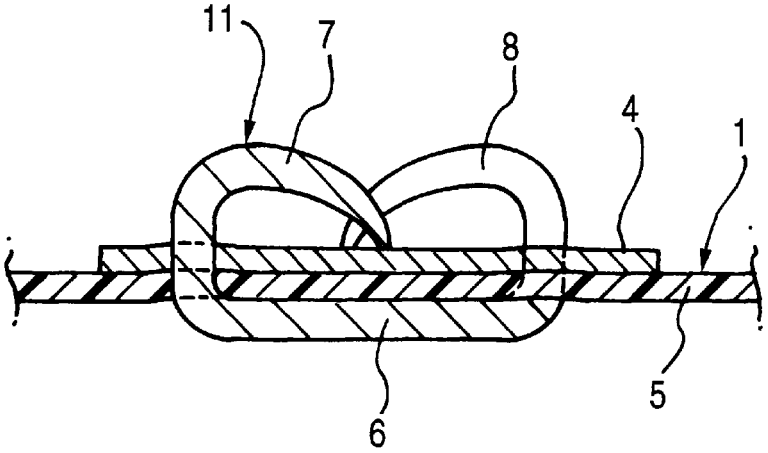
FIG. 15 is a sectional view taken in the direction of arrows along line XV—XV of FIG. 14.
Figure 16:
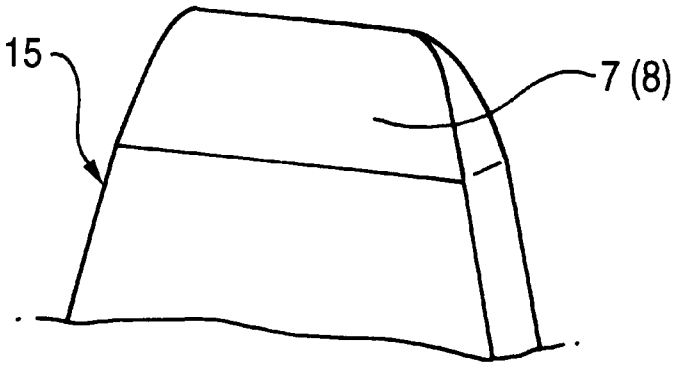
FIG. 16 is an enlarged view illustrating an end part of piercing portions of another improved related electrical connection terminal.
Figure 17:
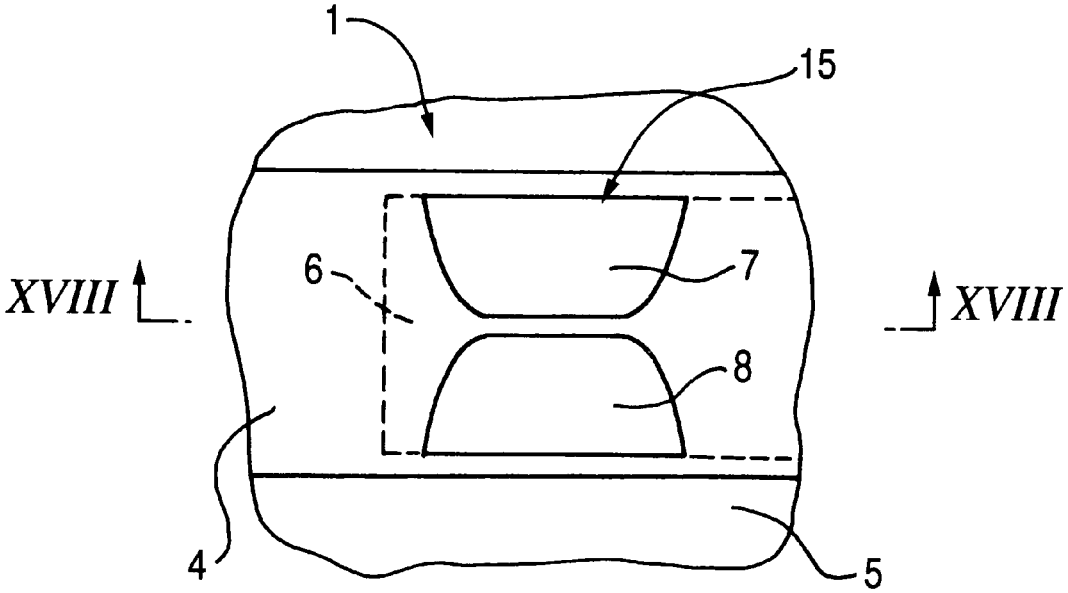
FIG. 17 is a plan view illustrating a state in which the related electrical connection portion shown in FIG. 16 is attached to a flat circuit body.
Figure 18:
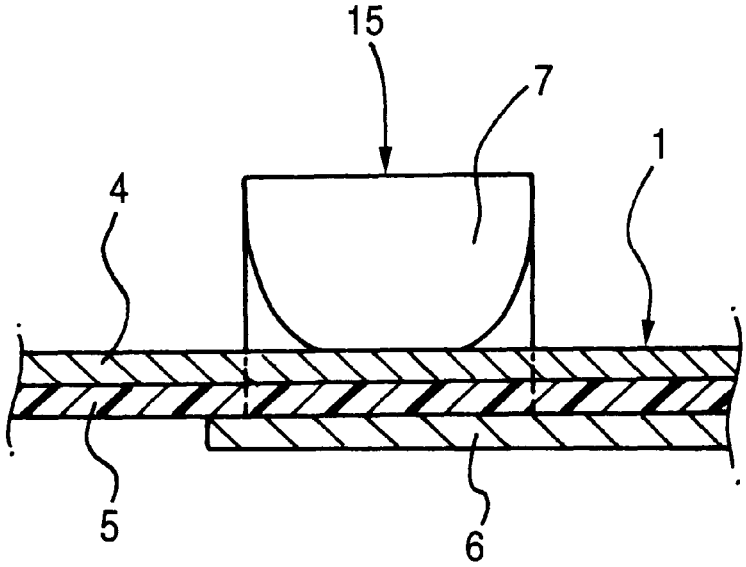
FIG. 18 is a sectional view taken in the direction of arrows along line XVIII—XVIII of FIG. 17.
Figure 19:
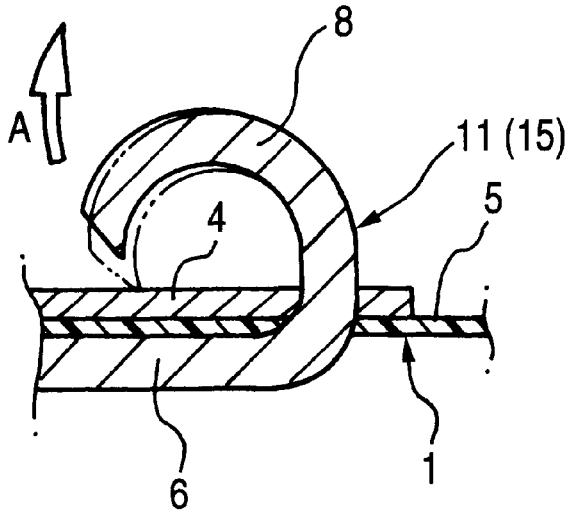
FIG. 19 is a primary-part sectional view illustrating a spring-back operation of a primary part of each of the piercing portions of the related electrical connection terminal.
Figure 20:
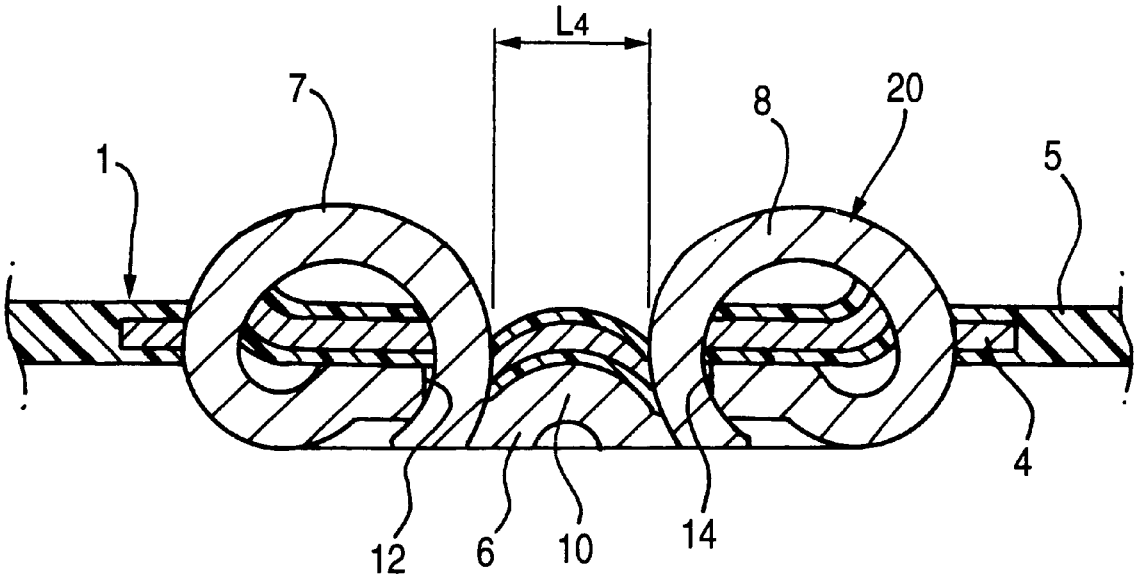
FIG. 20 is a transverse sectional view illustrating a connection portion at which another related electrical connection terminal is connected to a flat circuit body.

The flat circuit body 1 to which the electrical connection terminal 21 according to the embodiment is connected has the same structure as that of the flat circuit body 1 shown in FIG. 10, and is an FFC (Flexible Flat Cable) finished as a band-like cable which includes a thin-film-like insulating coating 5 covering a plurality of long-thin-plate-like conductors 4 and has flexibility, as a whole. Incidentally, an FPC (Flexible Printed Circuit), in which conductors are formed by performing a pattern printing method, maybe used as the flat circuit body.

Each of the end parts of the piercing portions 25 and 26 of the electrical connection terminal 21 has a pair of piercing blades 31, 31 (or 32, 32) formed by providing a notch portion 34 (or 35) therebetween. As illustrated in FIG. 2, the positions, at which the piercing portions 25 and 26 paired to each other are erected on the opposite side edge parts of the planar portion 23, are suitably offset from each other so that one of the piercing blades 32 (or 31) of one of the opposed piercing portions 25 and 26 is placed at the notching portion 34 (or 35) of the other piercing portion 25 or 26.

Each of the notch portions 34 (or 35) is formed so that the shape of the contour thereof corresponds to the shape of the contour of the opposed piercing blade 32 (or 31). When the piercing portions 25 and 26 which are erected and face each other are folded back in a direction in which the end parts thereof approach each other after the end parts thereof penetrate the flat circuit body 1, one of the piercing blades 32 provided at the end of one 25 of the opposed piercing portions is made to be inserted into the notch portion 35 provided at the end of the other piercing portion 26, and one of the piercing blade 31 provided at the end of one 26 of the opposed piercing portions is made to inserted into the notch portion 34 provided at the end of the other piercing portion 25.

A convex portion (or indent portion) 40 is formed at the center of the planar portion 23 of the electrical connection terminal 21 of this embodiment. When the piercing portions 25 and 26 are folded back and formed in a direction in which the piercing portions 25 and 26 approach each other, the convex portion 40 pushes up the central portion of the conductor 4 of the flat circuit body 1, thereby enhancing a nipping force exerted between the conductor 4 and each of the piercing portion 25 and 26.

That is, in the aforementioned electrical connection terminal 21 of this embodiment, each of the piercing portions 25 and 26 which are erected and face each other has a sharp end part having a pair of piercing blades 31, 31 (or 32, 32) provided at an end thereof. Therefore, each of the piercing portions 25 and 26 can easily penetrate an insulating coating 5 and conductors 4 of the flat circuit body 1.

As illustrated in FIGS. 3 to 5, the piercing portions 25 an 26 which are erected and face each other are adapted so that when the piercing portions 25 and 26 are folded back so that the end parts thereof approach each other, after the piercing portions 25 and 26 penetrate the flat circuit body 1, the piercing blade 31 (or 32) provided at the end part of each of the piercing portions 25 (or 26) is made to be inserted into the notching portion 35 (or 34) formed in the end part of the opposed counterpart piercing portion 26 (or 25).

Therefore, in the electrical connection terminal 21, the widths of the folded-back parts of the opposed piercing portions 25 and 26 partly overlap with each other, so that the occupied width $L_3$ of the opposed piercing portions 25 and 26 on the corresponding conductor 4 of the flat circuit body 1 can be reduced by the dimension L of an overlapping width of each of the folded parts of the piercing portions 25 and 26. Consequently, a reduction in the width of the flat circuit body 1 can be realized by narrowing the width of each of the conductors 4 of the flat circuit body 1.

Each of the piercing portions 25 and 26 to be folded back on the corresponding conductor 4 of the flat circuit body 1 has a structure including a pair of piercing blades 31, 31 (or 32, 32) provided at the end part thereof. As illustrated in FIG. 6, each of the piercing blades 31, 31 (or 32, 32) is pressure-contacted with the corresponding conductor 4 so that the pair of piercing blades 31, 31 hold the flat circuit body 1 by sandwiching the body 1. Therefore, the number of nipping places, at which the flat circuit body 1 is held and sandwiched by the pairs of piercing blades 31, 31, is increased. Moreover, as indicated by areas S1, S2, S3, and S4, each of which is surrounded by a one-dot chain line, a plurality of nipping places are arranged in a staggered manner. Consequently, the sandwiched conductors 4 become difficult to be shifted.

Furthermore, the end parts of the piercing portions 25 and 26 are brought into contact with each other in a wide range R surrounded by a two-dot chain line in FIG. 7. Thus, each of the piercing portions 25 and 26 can restrict the counterpart piercing portion 26 or 25 from performing a spring-back operation.

Therefore, the electrical connection terminal 21 of this embodiment can increase the nipping force, which is exerted on the conductors 4 of the flat circuit body 1, and the contact area therebetween, and can restrict the piercing portions 25 and 26 from performing a spring-back operation, and can improve the electrical and mechanical connection characteristics of the connection between the flat circuit body 1 and the terminal 2.

Incidentally, the configuration of the electrical connection terminal of the invention is not limited to that of the aforementioned embodiment. Needless to say, various modifications thereof may be provided according to the gist of the invention.

For example, in the aforementioned embodiment, two pairs of the piercing portions 25 and 26 are provided on both sides of the planar portion 23 of the electrical connection terminal 21. However, it is sufficient for the electrical connection terminal of the invention to have at least one pair of piercing portions. The number of pairs of piercing portions is suitably set from the viewpoint of ensuring the mechanical connection strength and the electrical contact area.

Further, for instance, similarly as the piercing portion 41, each of the piercing portions of the electrical connection terminal of the invention may have three piercing blades 43, which are formed by providing two notch portions 46 therein. As long as the piercing blades of one of the piercing portions of each of the pairs can be inserted into the notch portion of the other piercing portion thereof, each of the piercing portions of the electrical connection terminal of the invention may have a plurality of piercing blades.

With the aforementioned configuration, when the piercing portions erected in such a way as to face each other are folded back in a direction in which the end parts thereof approach each other, after the piercing portions are caused to penetrate the flat circuit body, the piercing blade provided at an end of each of the piercing portions is made to be inserted into the notch portion formed in the end part of the opposed counterpart piercing portion.

Thus, the widths of the folded-back parts of the opposed piercing portions partly overlap with each other. The occupied width of the piercing portions on the conductor of the flat circuit body can be reduced by the overlapped width. Furthermore, the piercing blade of one of the opposed piercing portions is made to be inserted into the notch part of the other piercing portion, so that each of the piercing portions can restrict the opponent piercing portion from performing a spring-back operation.

Further, each of the piercing portions, which is folded back after penetrating the coating and the conductor of the flat circuit body, has a structure in which each of the piercing portions has a plurality of blades at an end thereof.

This facilitates the penetration of the end part of each of the piercing portions through the flat circuit body. Moreover, because a plurality of piercing blades provided at the end part of each pair of the opposed piercing portions, which are folded back on the conductor after the penetration thereof, abut against the conductor in such a manner as to support the flat circuit body from both sides, the number of places, at which the flat circuit body is supported by being sandwiched, can be increased.

Therefore, the invention can provide a favorable electrical connection terminal enabled to improve the electrical conductivity thereof to a flat circuit body and enabled to realize reduction in the width of the flat circuit body.

What is claimed is:

1. An electrical connection terminal adapted to be connected to a flat circuit body, comprising:

a planar portion; and a pair of piercing portions erected on opposite side edge parts of the planar portion, each of the pair of piercing portions including, a plurality of piercing blades formed at an end of the piercing portion, and a notch portion formed between the plurality of piercing blades, wherein one of the plurality of piercing blades of one of the pair of piercing portions is placed at a position of the notch portion of the other piercing portion, and wherein when the pair of piercing portions penetrates the flat circuit body and are folded back in a direction in which the pair of piercing portions approach each other, the one of the plurality of piercing blade of one of the pair of piercing portion is inserted into the notch portion of the other piercing portion.

2. The electrical connection terminal according to claim 1, wherein the planar portion is provided with a convex portion at a center thereof.

3. The electrical connection terminal according to claim 1, wherein the pair of piercing portions offset each other in a direction in which the planar portion extends.

* * * * *